US009862080B2

(12) United States Patent
Cheng

(10) Patent No.: US 9,862,080 B2
(45) Date of Patent: Jan. 9, 2018

(54) DOUBLE-ENDED WRENCH SET WITH IDENTICAL TORQUE HOLES

(71) Applicant: KANTAS PRODUCTS CO., LTD., Taipei (TW)

(72) Inventor: Yang-Fu Cheng, Taipei (TW)

(73) Assignee: KANTAS PRODUCTS CO., LTD., Taipei (TW)

( * ) Notice: Subject to any disclaimer, the term of this patent is extended or adjusted under 35 U.S.C. 154(b) by 290 days.

(21) Appl. No.: 14/953,656

(22) Filed: Nov. 30, 2015

(65) Prior Publication Data

US 2017/0120430 A1 May 4, 2017

(30) Foreign Application Priority Data

Oct. 29, 2015 (TW) ..... 104135580 A

(51) Int. Cl.

| | |
|---|---|
| ***B25B 23/142*** | (2006.01) |
| ***B25B 13/56*** | (2006.01) |
| ***B25B 23/00*** | (2006.01) |
| ***B25B 13/04*** | (2006.01) |
| ***B25B 13/08*** | (2006.01) |

(52) U.S. Cl.

CPC ..... *B25B 23/1427* (2013.01); *B25B 13/04* (2013.01); *B25B 13/08* (2013.01); *B25B 13/56* (2013.01); *B25B 23/0007* (2013.01); *B25B 23/0035* (2013.01)

(58) Field of Classification Search

CPC ..... B25B 13/04; B25B 13/08; B25B 13/56; B25B 23/1427; B25B 23/0007; B25B 23/0035; B25G 1/005; B25G 1/085

See application file for complete search history.

(56) References Cited

U.S. PATENT DOCUMENTS

| | | | | |
|---|---|---|---|---|
| 1,402,373 A * | 1/1922 | Palmer | B25B 13/08 | 81/125.1 |
| 1,877,466 A * | 9/1932 | Koster | B25B 13/56 | 206/376 |
| 2,083,130 A * | 6/1937 | Sundberg | B25B 13/56 | 206/376 |
| 5,557,992 A * | 9/1996 | Macor | B25B 13/04 | 81/124.4 |
| 8,302,510 B2 * | 11/2012 | Macor | B25G 1/066 | 81/124.5 |
| 9,498,870 B2 * | 11/2016 | Davis | B25B 13/56 | |

* cited by examiner

*Primary Examiner* — David B Thomas
(74) *Attorney, Agent, or Firm* — Bacon & Thomas, PLLC

(57) ABSTRACT

The present invention is to provide a double-ended wrench set with identical torque holes, which comprises at least two double-ended wrenches having torque holes of a same configuration and a torque rod comprising a torque body and a torque head perpendicularly connected to the torque body, wherein each said torque hole is located in a wrench body of the double-ended wrench, the torque body has a greater length than the torque head, and the torque head has a cross section identical in configuration to the torque hole and is able to be fitted into said torque hole.

18 Claims, 4 Drawing Sheets

DOUBLE-ENDED WRENCH SET WITH IDENTICAL TORQUE HOLES

FIELD OF THE INVENTION

The present invention relates to a double-ended wrench set, more particularly to a double-ended wrench set having at least two double-ended wrenches with identical torque holes on wrench bodies thereof.

BACKGROUND OF THE INVENTION

The conventional double-ended wrench sets on the market typically include at least two double-ended wrenches in each set. For example, FIG. 1 shows a double-ended wrench set sold by STANLEY, a well-known US company, whose trademark STANLEY is also shown in the drawing. This double-ended wrench set includes fourteen double-ended wrenches 50, each having a wrench body 51 of a different length. The two ends of each wrench body 51 are provided with an opened opening 53 and an enclosed opening 54 respectively, wherein the two openings are of different specifications (e.g., hexagonal or box/ring-shaped) or sizes (e.g., with a diameter of 3/8, 7/16, 1/2, 9/16, 5/8, 11/16, 3/4, 13/16, 7/8, 15/16, 1, 1 1/16, 1 1/8, or 1 1/4 inches). Each opened opening 53 is configured for gripping two sides of a bolt or nut of the corresponding specification and size, while each enclosed opening 54 is designed to be placed around the periphery of a bolt or nut of the corresponding specification and size. The openings 53 and 54 at the two ends of each double-ended wrench 50 are different in specification or size from those of any another double-ended wrench 50. Moreover, the wrench bodies 51 of the double-ended wrenches 50 vary in length, depending on the sizes of the openings 53 and 54 of each double-ended wrench 50. The larger the openings 53 and 54 of each double-ended wrench 50 are, the longer the wrench body 51 will be.

With continued reference to FIG. 1, when the user inserts the fourteen double-ended wrenches 50 into a tool bag 60 and lays the tool bag 60 open on a workbench, the bag must occupy a significant area of the workbench. When rolled and tied up, the tool bag 60 is still quite bulky, let alone heavy, and therefore cannot be carried around with ease. In particular, the widely different lengths of the wrench bodies 51 of the double-ended wrenches 50 result in an asymmetric and distorted bundle once the tool bag 60 is rolled and tied, making it even more difficult to carry the loaded bag around.

Hence, the issue to be addressed by the present invention is to design a double-ended wrench set which not only occupies much less space than its prior art counterparts, but also has a symmetric, compact, and space-saving overall structure to facilitate storage, carrying, and display.

BRIEF SUMMARY OF THE INVENTION

In view of the fact that commercially available double-ended wrench sets are so heavy and bulky that they cannot be easily stored, carried around, or displayed, the inventor of the present invention incorporated years of practical experience into extensive research and repeated experiments and finally succeeded in developing a double-ended wrench set with identical torque holes as an effective solution to the problems stated above.

It is an objective of the present invention to provide a double-ended wrench set with identical torque holes. The double-ended wrench set includes at least two double-ended wrenches and a torque rod. The double-ended wrenches have identically configured torque holes, each formed in the wrench body of one double-ended wrench. Each wrench body has two ends, which are respectively provided with an opened opening and an enclosed opening that are of different specifications (e.g., hexagonal, octagonal, dodecagonal, or box/ring-shaped) or sizes (e.g., with a diameter of 3/8, 7/16, 1/2, 9/16, 5/8, 11/16, 3/4, 13/16, 7/8, 15/16, 1, 1 1/16, 1 1/8, or 1 1/4 inches). Each opened opening is configured for gripping two sides of a bolt or nut of the corresponding specification and size, and each enclosed opening, for being placed around the periphery of a bolt or nut of the corresponding specification and size. The openings at the two ends of each double-ended wrench are different in specification or size from those of any another double-ended wrench. The torque rod includes a torque body and a torque head. The torque body is perpendicularly connected to the torque head and has a greater length than the torque head in order to be grasped by the user for force application. The torque head has a cross section identical in configuration to the torque holes and can be fitted into each torque hole. When it is desired to fasten or loosen a bolt or nut, the user can do so by picking the double-ended wrench of the corresponding specification and size, placing the bolt or nut into the appropriate opening of the double-ended wrench, fitting the torque head into the torque hole of the double-ended wrench, and then holding and applying a force to the torque body to fasten or loosen the bolt or nut.

According to another objective of the present invention, the torque body has a cross section identical in configuration to the torque holes and can be fitted into the torque holes one after another, thereby mounting the double-ended wrenches sequentially around the torque body. In addition, the end of the torque body that is distant from the torque head can be connected with a blocking member which has a greater diameter than the torque holes. Once the double-ended wrenches are sequentially mounted around the torque body, the blocking member can be connected to the end of the torque body that is distant from the torque head to retain the double-ended wrenches sequentially mounted around the torque body and prevent the double-ended wrenches from falling off. Thus, thanks to its symmetric, compact, and space-saving overall structure, the double-ended wrench set can be easily stored, carried around, and displayed.

According to yet another objective of the present invention, the end of the torque body that is distant from the torque head is provided with a first engaging configuration, and the blocking member is provided with a second engaging configuration at one end. The first engaging configuration can engage with the second engaging configuration in order to connect the torque body and the blocking member together. Further, the opposite end of the blocking member is provided with a hanging hook or hanging loop so that, after the double-ended wrenches are sequentially mounted around the torque body, the torque rod and the double-ended wrenches thereon can be hung on a hanger via the hanging hook or hanging loop and thus displayed on a wall in a space-efficient way.

According to still another objective of the present invention, the torque rod further includes a torque adjusting mechanism, through which the torque body is perpendicularly connected to the torque head. The torque adjusting mechanism can be used to set the magnitude of the torque applied by the torque body to the torque head so as to fasten a bolt or nut in the optimal manner.

BRIEF DESCRIPTION OF THE SEVERAL VIEWS OF THE DRAWINGS

The above and other objectives, as well as the technical and structural features, of the present invention can be more clearly understood by referring to the following detailed description of some illustrative embodiments in conjunction with the accompanying drawings, in which.

DETAILED DESCRIPTION OF THE INVENTION

Figure 1:
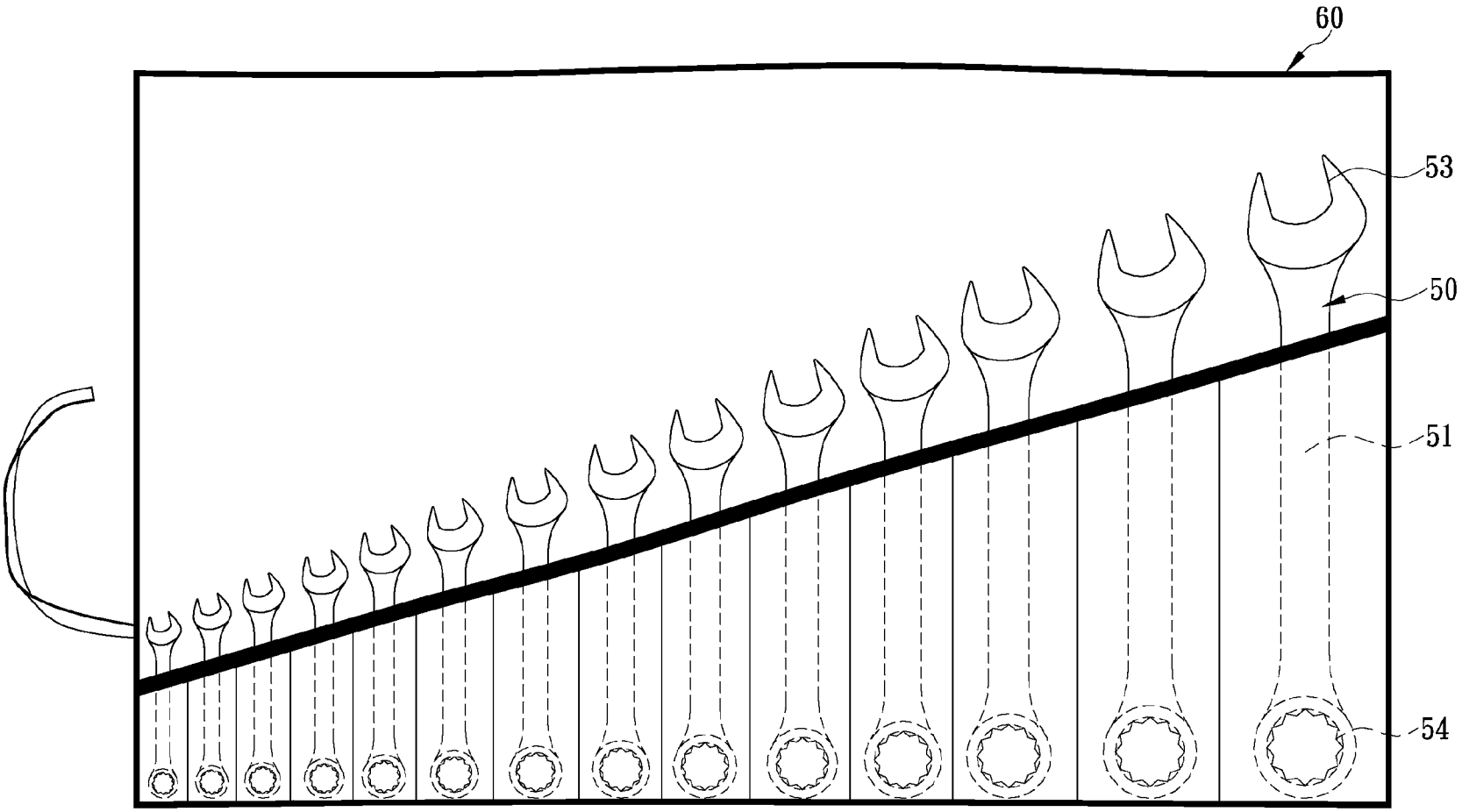
FIG. 1(Prior Art)
FIG. 1 schematically shows a commercially available double-ended wrench set.
Figure 2:
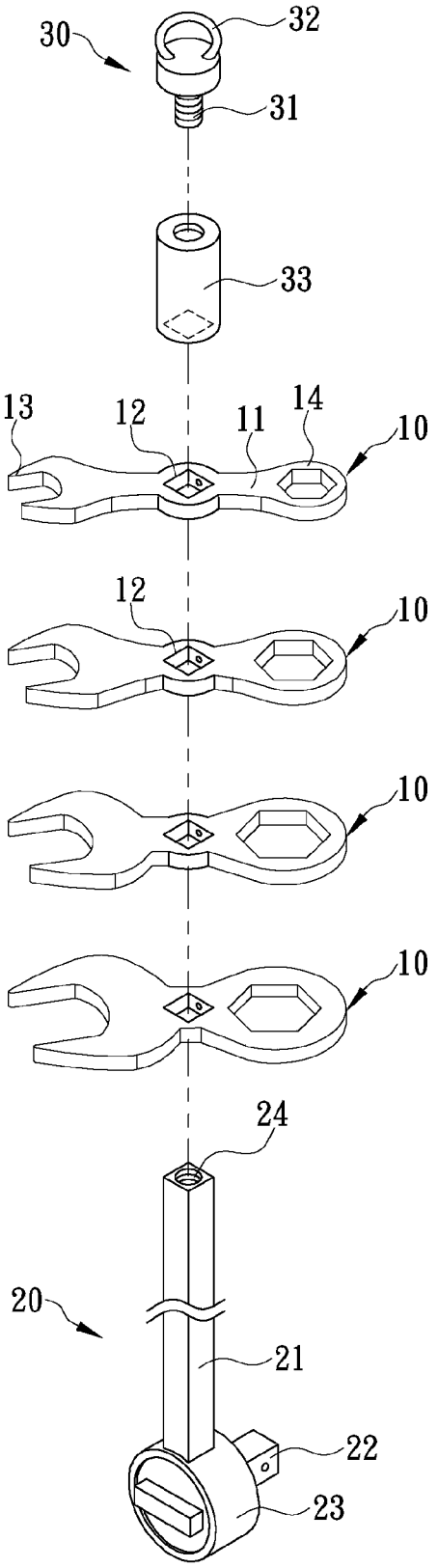
FIG. 2 is an exploded perspective view of a double-ended wrench set according to the present invention.
Figure 3:
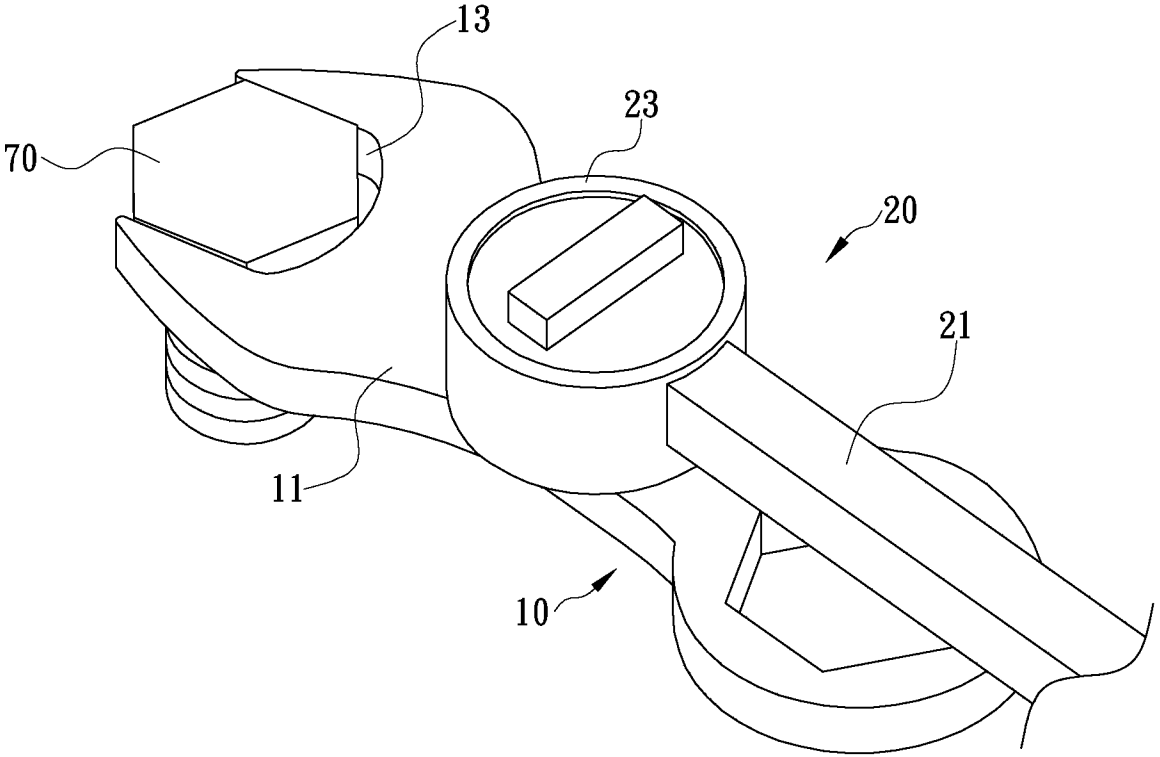
FIG. 3 schematically shows how a double-ended wrench set according to the present invention is operated.

According to a preferred embodiment of the present invention as shown in FIG. 2, a double-ended wrench set with identical torque holes includes at least two double-ended wrenches 10 (four double-ended wrenches 10 being shown in FIG. 2 by way of example only) and a torque rod 20. The double-ended wrenches 10 have torque holes 12 of the same configuration, and the torque holes 12 are respectively provided in the wrench bodies 11 of the double-ended wrenches 10. Each wrench body 11 is provided with an opened opening 13 and an enclosed opening 14 at two ends respectively, wherein the two openings are of different specifications (e.g., hexagonal, octagonal, dodecagonal, or box/ring-shaped) or sizes (e.g., with a diameter of 3/8, 7/16, 1/2, 9/16, 5/8, 11/16, 3/4, 13/16, 7/8, 15/16, 1, 1 1/16, 1 1/8, or 1 1/4 inches). As shown in FIG. 3, each opened opening 13 is configured for gripping two sides of a bolt 70 or nut of the corresponding specification and size, and each enclosed opening 14, for being placed around the periphery of the bolt 70 or nut. The openings 13 and 14 at the two ends of each double-ended wrench 10 are different in specification or size from those of any another double-ended wrench 10. Referring back to FIG. 2, the torque rod 20 includes a torque body 21 and a torque head 22. The torque body 21 is perpendicularly connected to the torque head 22 and is longer than the torque head 22 in order to be held by the user for force application. In addition, the torque head 22 has a cross section identical in configuration to the torque holes 12. Referring to FIG. 3 in conjunction with FIG. 2, the torque head 22 can be fitted into the torque hole 22 so that, when subjected to force application, the torque body 21 applies a force through the torque head 22 to the torque hole 12 to fasten or loosen the bolt 70 or nut. In this embodiment, it is preferable, but not required, that the wrench bodies 11 of the double-ended wrenches 10 have the same length, and that each torque hole 12 is located at the middle of a wrench body 11.

Referring to FIG. 3, in order to fasten or loosen the bolt 70 (or nut), the user selects the double-ended wrench 10 of the corresponding specification and size and places the opened opening 13 of the double-ended wrench 10 around the bolt 70. Then, the torque head 22 of the torque rod 20 is fitted into the torque hole 12, and the bolt 70 can be fastened or loosened by holding and applying a force to the torque body 21.

Figure 4:
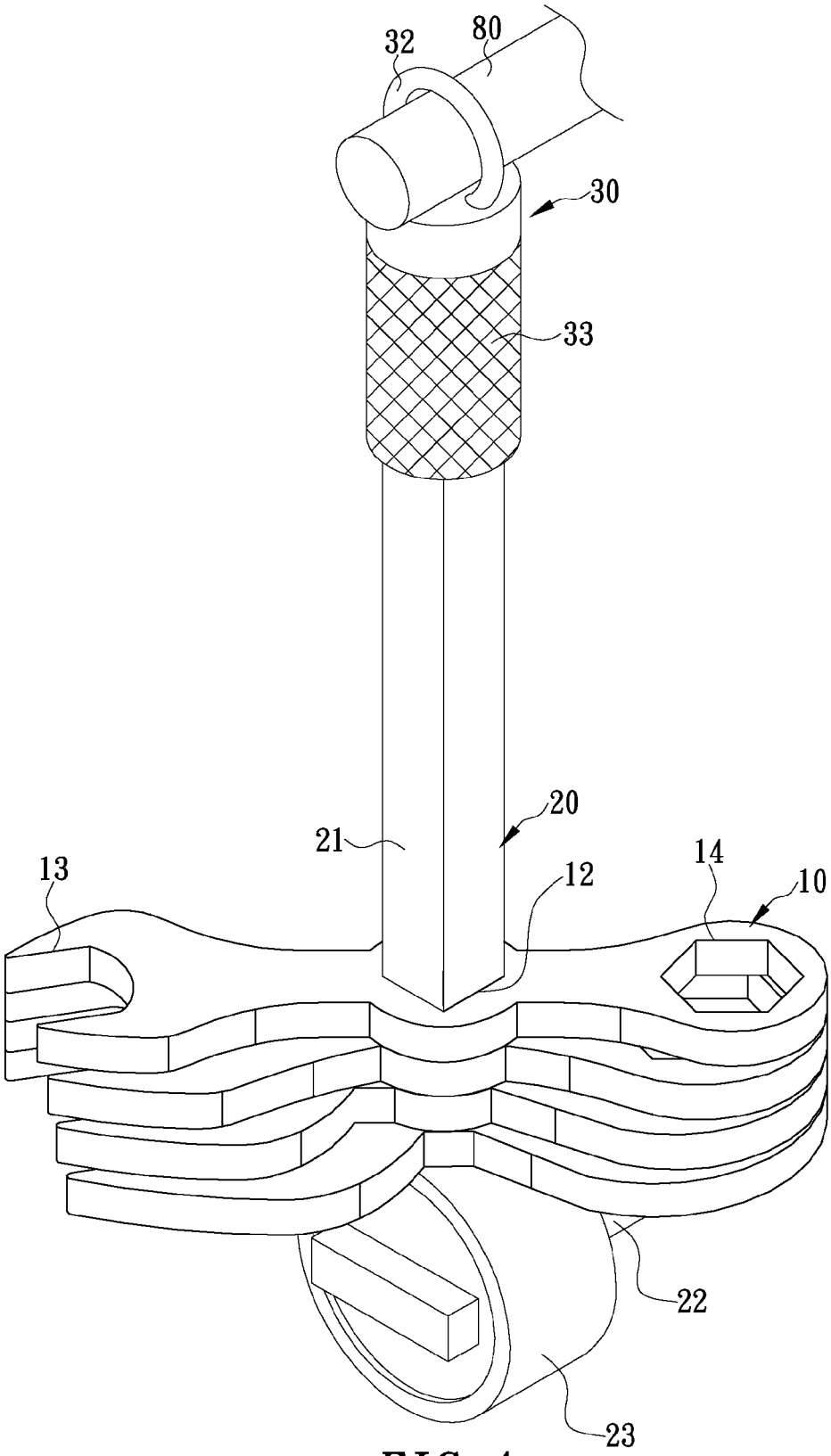
FIG. 4 schematically shows how a double-ended wrench set according to the present invention is displayed.

In another embodiment of the present invention, referring back to FIG. 2, the cross section of the torque body 21 of the torque rod 20 is so designed that it has the same configuration as the torque holes 12 to facilitate storage, carrying, and display of the double-ended wrench set. By fitting the torque body 21 successively through the torque holes 12, the double-ended wrenches 10 can be mounted sequentially around the torque body 21 to form a symmetric and compact double-ended wrench set that does not take up too much space. In this embodiment, with a view to facilitating grasping and force application, the torque rod 20 can be further mounted with a handle 33 at the end of the torque body 21 that is distant from the torque head 22. In addition, the same end of the torque body 21 can be connected with a blocking member 30 by a press fit, by an engaging means, or by threaded connection. Once the double-ended wrenches 10 are sequentially mounted around the torque body 21 and the handle 33 is mounted to the torque body 21, the blocking member 30 can be installed in place and thus pressed against the handle 33 to prevent the double-ended wrenches 10 from falling off the torque body 21. Moreover, the torque rod 20 is provided with a first engaging configuration 24 (e.g., a screw thread) at the end of the torque body 21 that is distant from the torque head 22, and the blocking member 30 is provided with a second engaging configuration 31 (e.g., a screw thread) at one end. The first engaging configuration 24 can engage (e.g., by threaded connection) with the second engaging configuration 31 to connect the torque body 21 and the blocking member 30 together such that the torque rod 20 and the double-ended wrenches 10 form a symmetric, compact, and space-saving wrench set. Also, referring to FIG. 2, the opposite end of the blocking member 30 is provided with a hanging loop (or hanging hook) 32. After the double-ended wrenches 10 are sequentially mounted around the torque body 21 and the blocking member 30 is engaged with the torque body 21, the hanging loop (or hanging hook) 32 can be used to hang the torque rod 20, together with the double-ended wrenches 10 mounted thereon, on a hanger 80, as shown in FIG. 4, allowing the double-ended wrench set to be displayed on the wall of a workshop in a symmetric, compact, and space-saving manner.

In other embodiments of the present invention, referring again to FIG. 2 and FIG. 3, the torque rod 20 further includes a torque adjusting mechanism 23 for adjusting the torque applied to the bolt 70 or nut, or more specifically for setting the direction or magnitude of the torque, according to practical needs. The torque body 21 is perpendicularly connected to the torque head 22 via the torque adjusting mechanism 23 so that the user can use the torque adjusting mechanism 23 to set the magnitude of the torque applied by the torque body 21 to the torque head 22 and thereby fasten the bolt 70 or nut optimally.

While the invention herein disclosed has been described by means of specific embodiments, numerous modifications and variations could be made thereto by those skilled in the art without departing from the scope of the invention set forth in the claims.

What is claimed is:

1. A double-ended wrench set with identical torque holes, comprising:

at least two double-ended wrenches having torque holes of a same configuration, wherein each said torque hole is located in a wrench body of said double-ended wrench, each said wrench body has two ends respectively provided with an opened opening and an enclosed opening different from the opened opening in specification or size, each said opened opening is configured to grip two sides of a bolt or nut of a corresponding specification and size, each said enclosed opening is configured to be placed around a periphery of a bolt or nut of a corresponding specification and size, and the openings at the two ends of each said double-ended wrench are different in specification or size from the openings at the two ends of other said double-ended wrench; and a torque rod comprising a torque body and a torque head, wherein said torque body is perpendicularly connected to said torque head, said torque body has a greater length than said torque head, and said torque head has a cross section identical in configuration to said torque hole and is able to be fitted into said torque hole.

2. The double-ended wrench set of claim 1, wherein said torque body has a cross section identical in configuration to the torque hole and is able to be fitted into the torque holes sequentially.

3. The double-ended wrench of claim 2, wherein the torque body has an end distant from the torque head and connectable with a blocking member, and the blocking member has a greater diameter than the torque holes.

4. The double-ended wrench set of claim 3, wherein the end of the torque body that is distant from the torque head is provided with a first engaging configuration, and the blocking member has an end provided with a second engaging configuration engageable with the first engaging configuration.

5. The double-ended wrench set of claim 4, wherein the end of the torque body that is distant from the torque head is mountable with a handle, and the blocking member is pressable against the handle.

6. The double-ended wrench set of claim 5, wherein the blocking member has an opposite end provided with a hanging hook or hanging loop.

7. The double-ended wrench set of claim 1, wherein the torque rod further comprises a torque adjusting mechanism, the torque body is perpendicularly connected to the torque head through the torque adjusting mechanism, and the torque adjusting mechanism is configured to set the magnitude of a torque applied by the torque body to the torque head.

8. The double-ended wrench set of claim 2, wherein the torque rod further comprises a torque adjusting mechanism, the torque body is perpendicularly connected to the torque head through the torque adjusting mechanism, and the torque adjusting mechanism is configured to set the magnitude of a torque applied by the torque body to the torque head.

9. The double-ended wrench set of claim 3, wherein the torque rod further comprises a torque adjusting mechanism, the torque body is perpendicularly connected to the torque head through the torque adjusting mechanism, and the torque adjusting mechanism is configured to set the magnitude of a torque applied by the torque body to the torque head.

10. The double-ended wrench set of claim 4, wherein the torque rod further comprises a torque adjusting mechanism, the torque body is perpendicularly connected to the torque head through the torque adjusting mechanism, and the torque adjusting mechanism is configured to set the magnitude of a torque applied by the torque body to the torque head.

11. The double-ended wrench set of claim 5, wherein the torque rod further comprises a torque adjusting mechanism, the torque body is perpendicularly connected to the torque head through the torque adjusting mechanism, and the torque adjusting mechanism is configured to set the magnitude of a torque applied by the torque body to the torque head.

12. The double-ended wrench set of claim 6, wherein the torque rod further comprises a torque adjusting mechanism, the torque body is perpendicularly connected to the torque head through the torque adjusting mechanism, and the torque adjusting mechanism is configured to set the magnitude of a torque applied by the torque body to the torque head.

13. The double-ended wrench set of claim 7, wherein the wrench bodies of the double-ended wrenches are of a same length, and said torque hole is located at a middle of said wrench body.

14. The double-ended wrench set of claim 8, wherein the wrench bodies of the double-ended wrenches are of a same length, and said torque hole is located at a middle of said wrench body.

15. The double-ended wrench set of claim 9, wherein the wrench bodies of the double-ended wrenches are of a same length, and said torque hole is located at a middle of said wrench body.

16. The double-ended wrench set of claim 10, wherein the wrench bodies of the double-ended wrenches are of a same length, and said torque hole is located at a middle of said wrench body.

17. The double-ended wrench set of claim 11, wherein the wrench bodies of the double-ended wrenches are of a same length, and said torque hole is located at a middle of said wrench body.

18. The double-ended wrench set of claim 12, wherein the wrench bodies of the double-ended wrenches are of a same length, and said torque hole is located at a middle of said wrench body.

* * * * *